US008899901B2

(12) United States Patent
Hilton

(10) Patent No.: US 8,899,901 B2
(45) Date of Patent: Dec. 2, 2014

(54) PIPE HANDLING APPARATUS AND METHOD

(75) Inventor: Thomas Dale Hilton, Laurel, MS (US)

(73) Assignee: Warrior Energy Services Corporation, Houston, TX (US)

( * ) Notice: Subject to any disclaimer, the term of this patent is extended or adjusted under 35 U.S.C. 154(b) by 113 days.

(21) Appl. No.: 13/523,238

(22) Filed: Jun. 14, 2012

(65) Prior Publication Data

US 2013/0336747 A1 Dec. 19, 2013

(51) Int. Cl.
*E21B 19/15* (2006.01)
*E21B 19/14* (2006.01)

(52) U.S. Cl.
CPC ..... *E21B 19/14* (2013.01); *E21B 19/155* (2013.01); *E21B 19/15* (2013.01)
USPC ..... 414/22.54; 414/22.61

(58) Field of Classification Search
USPC ..... 175/52; 198/468.6, 861.5; 254/133 R, 254/88, 8 R, 9 C, 9 R; 312/42; 414/22.51–22.59, 22.61–22.69, 22.71, 414/745.1, 745.4, 745.5, 745.9, 746.1, 414/746.2, 746.4
See application file for complete search history.

(56) References Cited

U.S. PATENT DOCUMENTS 3,785,506 A * 1/1974 Crocker et al. ..... 414/745.8
3,810,553 A * 5/1974 Crocker et al. ..... 414/22.61
4,403,898 A 9/1983 Thompson
4,643,273 A * 2/1987 Stokoe ..... 182/2.9
4,684,314 A * 8/1987 Luth ..... 414/746.1
5,249,642 A * 10/1993 Kishi ..... 182/2.11
6,390,762 B1 5/2002 Peery et al.
6,488,161 B1 * 12/2002 Bean ..... 212/300
6,547,034 B1 * 4/2003 Waters ..... 182/62.5
7,021,880 B2 * 4/2006 Morelli et al. ..... 414/22.59
7,246,684 B2 * 7/2007 Bean ..... 187/224
7,404,697 B2 7/2008 Thompson
7,614,492 B2 * 11/2009 Muse et al. ..... 198/468.6
7,635,249 B2 12/2009 Guidroz
7,665,944 B2 2/2010 Guidroz
7,832,974 B2 11/2010 Fikowski et al.
7,883,309 B2 * 2/2011 Smith et al. ..... 414/22.55
8,016,536 B2 * 9/2011 Gerber et al. ..... 414/22.61
8,157,495 B1 4/2012 Randall
2009/0053013 A1 2/2009 Maltby
2009/0252576 A1 10/2009 Gerber et al.
2010/0111646 A1 5/2010 Smith et al.
2010/0135750 A1 * 6/2010 Tarique ..... 414/22.54
2013/0336748 A1 12/2013 Hilton

* cited by examiner

*Primary Examiner* — Gregory Adams
(74) *Attorney, Agent, or Firm* — Winston & Strawn LLP

(57) ABSTRACT

Equipment for moving tubular members from a storage rack to an elevated platform floor is disclosed. A base-mounted articulated support structure has an arcuate trough mounted on top thereof. Loading arms are secured to a side of the pivotal trough for picking up one tubular member from the rack and moving to the platform floor. Unloading arms detachably securable to the trough facilitate movement of the tubular members from the platform floor onto the rack.

32 Claims, 12 Drawing Sheets

PIPE HANDLING APPARATUS AND METHOD

BACKGROUND OF THE INVENTION

This invention relates to oil and gas industry and, more particularly to an apparatus for moving elongated tubular members between a rack and a rig floor.

During drilling and completion operations, it is necessary to make up and/or break down long strings of tubular members such as drill pipe and casing. The string of pipe may be thousands of feet long, and it is therefore necessary to transport pipe joints, which can be up to 32 feet long, from a pipe rack located away from the rig up to the rig floor. When the drill string is tripped out of the hole, the string of pipe is broken down into separate joints and returned to the pipe rack. The drilling platform is usually at some distance from the pipe rack and is elevated above the ground by 15-20 feet.

The handling of oil well pipe is one of the most dangerous jobs on a drilling rig. Some of the pipe joints weigh thousands of pounds, and it is difficult to move the pipe from a horizontal position on the pipe rack into a vertical position overlying the borehole in the rig. The industry has developed various types of equipment to assist in transporting the pipe segments from the pipe rack to the platform and back to the pipe rack. Conventional pipe handling machines use a trailer, a carriage mounted on the trailer and a trough, which is supported by the carriage. The operators load one pipe segment at a time into the trough from the pipe rack. A lift arm moves the carriage to elevate one end of the trough to a platform floor, where rig operators use pick up arms to slide the pipe segment from the trough and lower the pipe segment into the borehole.

Even though part of the pipe handling process is assisted by the elevating carriage, the operators still need to manually lift the pipe segment from a horizontal pipe rack and carefully place it in the trough of the pipe handling machine. It is important to note that the exterior of the pipe segments has a protective anti-corrosive coating, which can be damaged if the pipe segment is dropped or scraped against an edge of the trough. In conventional equipment, the trough is affixed to the elevating arms and does not pivot or tilt.

U.S. Pat. No. 7,665,944 teaches a pipe handling method, which uses a longitudinally extending base frame assembly having a system of base rails or tracks, a movable carriage having a carriage frame and roller assembly for supporting the movable carriage on the frame base rails, and a pipe lifting structure that is mounted to this movable carriage. The carriage, and consequently the pipe lifting structure, is configured so that it may be moved as desired along the length of the base frame by means of the carriage rollers and base rail system to facilitate a desired lifting sequence. The pipe lifting structure has a semicircular pipe support trough that is supported by hydraulically driven telescopically extendable lifting arm assembles. The base end of each telescopically extendable lifting arm assembly is pivotally mounted to the carriage. The trough end of each lifting arm assembly is pivotally mounted to a lifting structure stabilizer frame that extends longitudinally between each lifting arm assembly.

While the method of U.S. Pat. No. 7,665,944 may work satisfactory in many circumstances, there remains a need for a pipe handling machine that would facilitate movement of the pipe segments from the pipe rack into the trough.

The present invention contemplates elimination of drawbacks associated with conventional methods and provision of a pipe handling apparatus and method that assists in moving pipe segments from and to the pipe rack.

SUMMARY OF THE INVENTION

It is, therefore, an object of the present invention to provide an improved pipe handling apparatus and method for use in oil and gas industry.

It is another object of the present invention to provide a pipe handling apparatus and method that facilitates movement of elongated tubular member, such as pipe segments, from a horizontal rack to platform floor and back to the pipe rack.

These and other objects of the invention are achieved through a provision of an apparatus and method for moving a tubular member between a storage rack and an elevated floor of a platform. The apparatus has an articulated support structure mounted on a base and carrying a semi-cylindrical pivotal trough on top thereof. Loading arms secured to the trough move to pick up a pipe from the storage rack when the trough is tilted towards the storage rack. When the support structure is elevated it moves the trough with the tubular member towards the platform floor.

Unloading arms are detachably securable to the trough as well. The support structure having a tubular member deposited into the trough at the platform floor is lowered and causes pivotal movement of the trough. The unloading arms guide the tubular member from the trough onto the storage rack.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
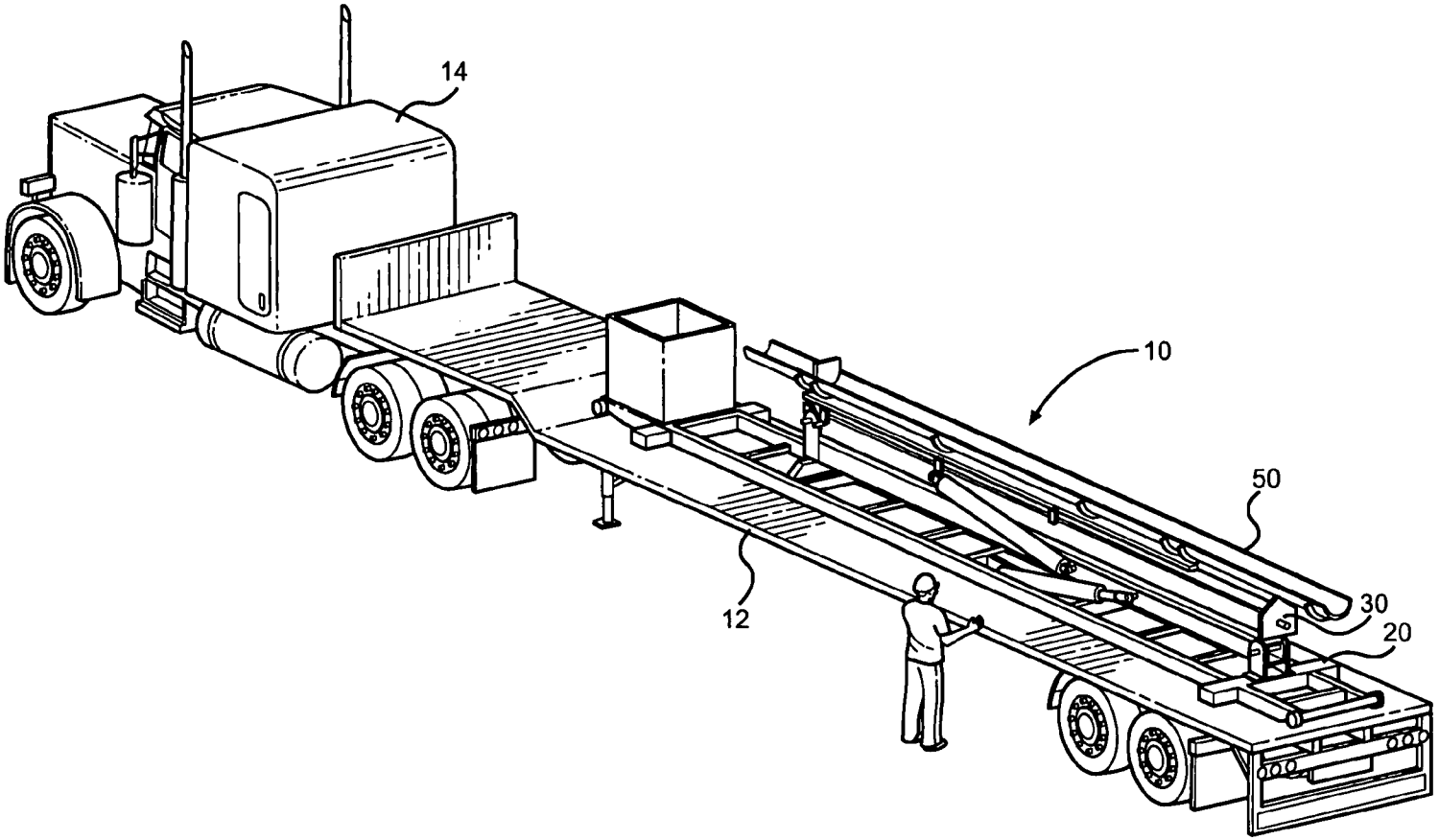
FIG. 1 is a perspective view of the pipe handling apparatus according to the present invention being unloaded from a carrier.
Figure 2:
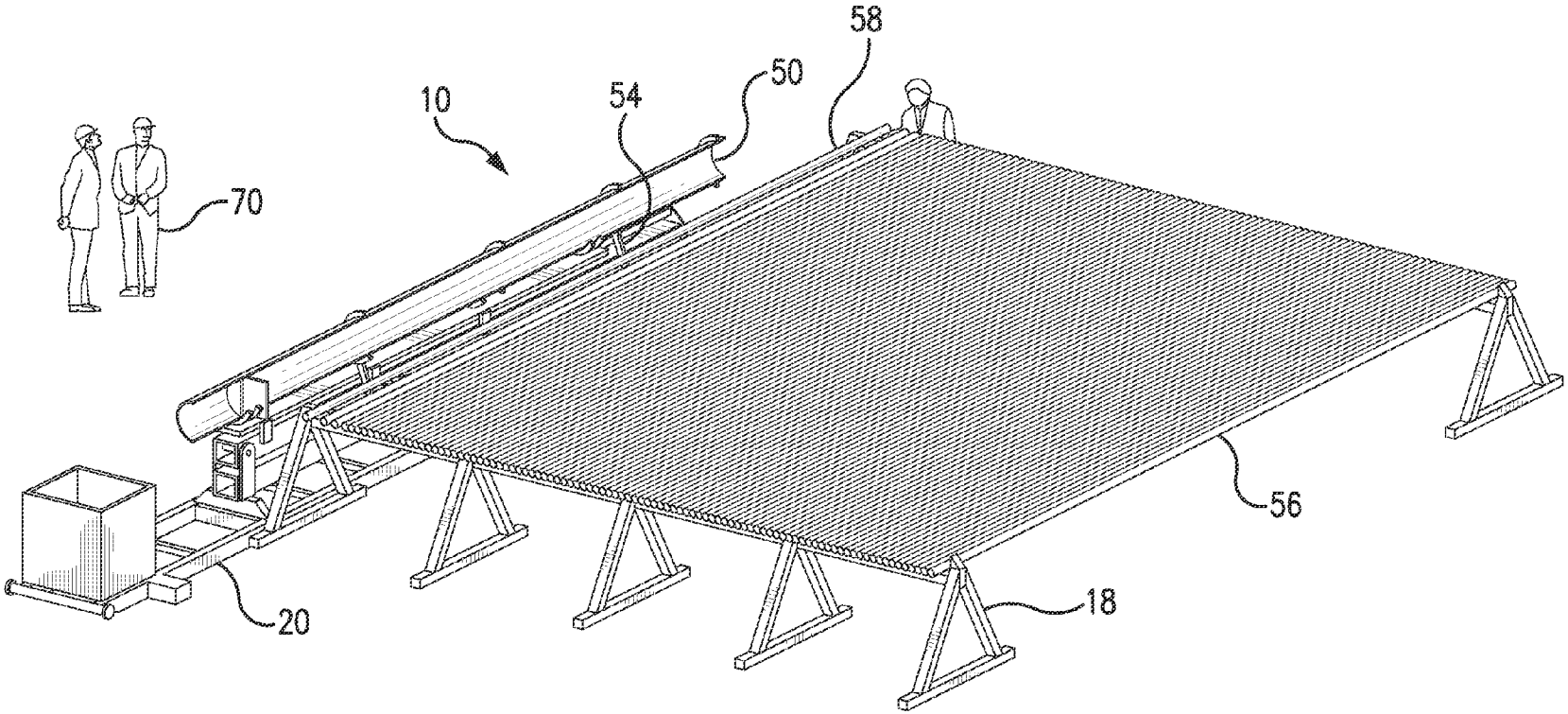
FIG. 2 illustrates position of the pipe handling apparatus adjacent an elevated storage rack, with the loading arms ready to pick up a tubular member.

Turning now to the drawings in more detail, numeral 10 designates the pipe handling apparatus according to this invention. The apparatus 10 can be delivered to a work site in any available manner, for instance a trailer 12 illustrated in FIG. 1. The trailer 12 can be attached to a towing vehicle 14 and transported to the designated location, such as a site of a drilling rig 16.

The apparatus 10 comprises a base, such as a skid 20, which supports the apparatus 10 in a longitudinal position during transport. The base 20 can be formed as a frame composed of a pair of parallel rails 22, 24 and a plurality of transverse bars 26 extending between the opposing rails 22, 24. The frame 20 can be positioned on the ground adjacent a storage rack 18 and the drilling rig 16 and moved to a preselected position using rotating roller or wheels 28 secured to ends of the elongated rails 22, 24.

Since the skid 20 is located on the bed of a vehicle 14, the vehicle 14 can be maneuvered into place so as to properly align with the centerline of the drilling rig 16. Once the proper alignment is achieved by the vehicle 14, the apparatus 10 can be unloaded to rest on the ground so as to effectively move the tubular between a storage position and the drilling rig 16 and back. The present invention is adaptable to various lengths of tubulars. The tubulars are used in wellbore and derrick operations, such as casing, tubing, drill pipe or stands of pipe that need to be moved from one location to another at the wellbore operations.

Figure 10:
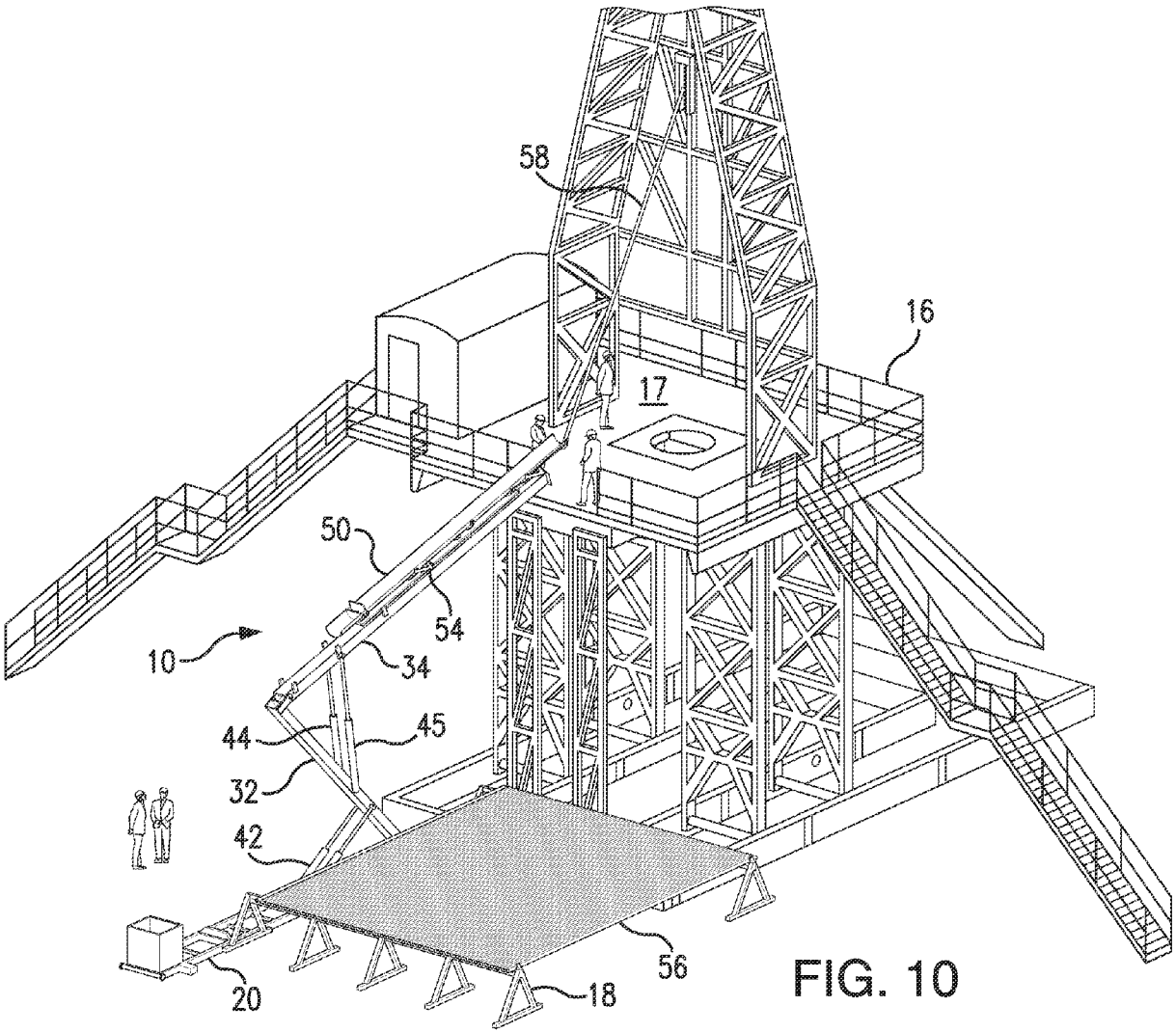
FIG. 10 illustrates the pipe handling apparatus reaching to a platform floor.

The pipe handling apparatus 10 also comprises an articulated support structure 30, which moves between a folded position shown in FIG. 1 to an extended position shown in FIG. 10 and a plurality of intermediate positions, as will be described in more detail hereinafter. The support structure 30 is comprised of a first elongated beam 32, a second elongated beam 34 and an articulated connecting beam 36 pivotally mounted between adjoining ends of the first beam 32 and the second beam 34. The first beam 32 comprises a lower end 38 and an upper end 39; the second beam 34 comprises a proximate end 40 and a distant end 41. The connecting beam 36 is pivotally secured between the upper end 39 of the first beam 32 and the proximate end 40 of the second beam 34.

The apparatus 10 comprises a system of hydraulically movable struts or cylinders, which move the first arm 32 and the second arm 34 between a folded position and extended positions. A lower pair of struts 42, 43 is positioned between the base 20 and the underside of the first arm 32. A second pair of struts 44, 45 is mounted between an upper surface of the first arm 32 and the underside of the second arm 34. Each of the struts 42-45 comprises telescopically extendable rods that can be extended and retracted hydraulically or using other suitable power source in relation to their respective pistons.

The second beam 34 pivotally supports an elongated arcuate trough 50, which can be formed as a semicylindrical body having longitudinal dimensions approximating longitudinal dimensions of tubulars to be handled by the apparatus 10. In one aspect of the invention, a longitudinal axis of the trough 50 extends substantially parallel to a longitudinal axis of the second arm 34 when the trough 50 is in a storage position shown in FIG. 1. The trough 50 slidably moves along the second arm 34 using a sliding assembly 55 mounted adjacent the proximate end 40 of the second arm 34. The sliding assembly 55 also acts as a stop preventing the tubular strand 58 from sliding down along the trough 50.

The trough 50 comprises parallel side edges 51, 52 extending along the length of the semicylindrical body. Two or more spaced-apart loading arms 54 are secured to the trough 50 adjacent the edge 52. For convenience, the edge 52 will be considered the right edge of the trough 52 when seen in the detail side views of FIGS. 3-5. Of course, depending on the location of the storage rack 18 of the tubulars 56, the loading arms 54 can be secured adjacent the left edge 51. The loading arms 54 have a generally L-shaped configuration with a first shorter part 55 and a second longer part 57.

Figure 4:
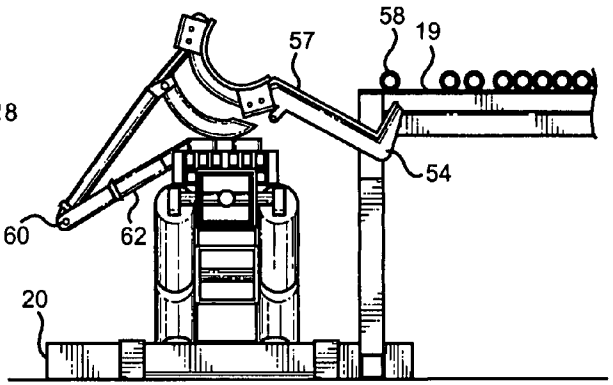
FIG. 4 is a detail side view illustrating the loading arm positioned for engaging a tubular member.
Figure 3:
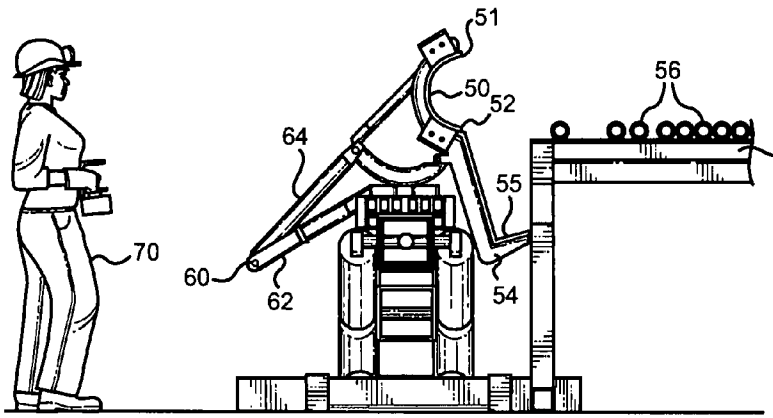
FIG. 3 is a detail side view illustrating a loading arm secured to one side of the pipe trough in a starting position.
Figure 5:
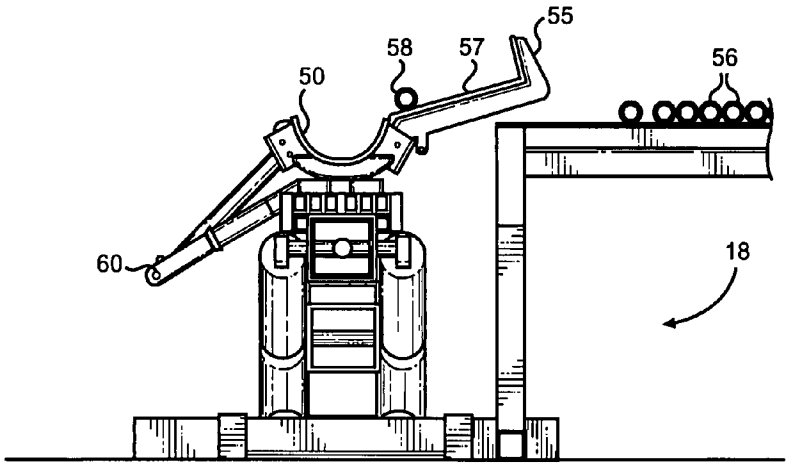
FIG. 5 is a detail side view illustrating the loading arm pivoted to guide the pipe segment into the pipe trough.

The trough 50 can tilt in relation to the second arm 34 between a storage position shown in FIG. 5 and loading positions shown in FIGS. 3 and 4. Articulated pivot assemblies 60 move the trough 50 between loading and unloading positions. The articulated pivot assemblies 60 comprise a first elongated bar 62 coupled to the second arm 34 and telescopically extendable second bar 64 pivotally connected to a free end of the first bar 62. The second bar 64 can be hydraulically operated.

During a loading operation, the apparatus 10 is positioned adjacent the storage rack 18, which stores a plurality of tubular members or tubular 56 in a horizontal position. An operator 70 activates the power source, such as a hydraulic motor (not shown) to raise the second arm 34 in general vertical alignment with the storage rack 18. Another worker may assist in urging the tubular member towards an edge of the rack 18.

Figure 6:
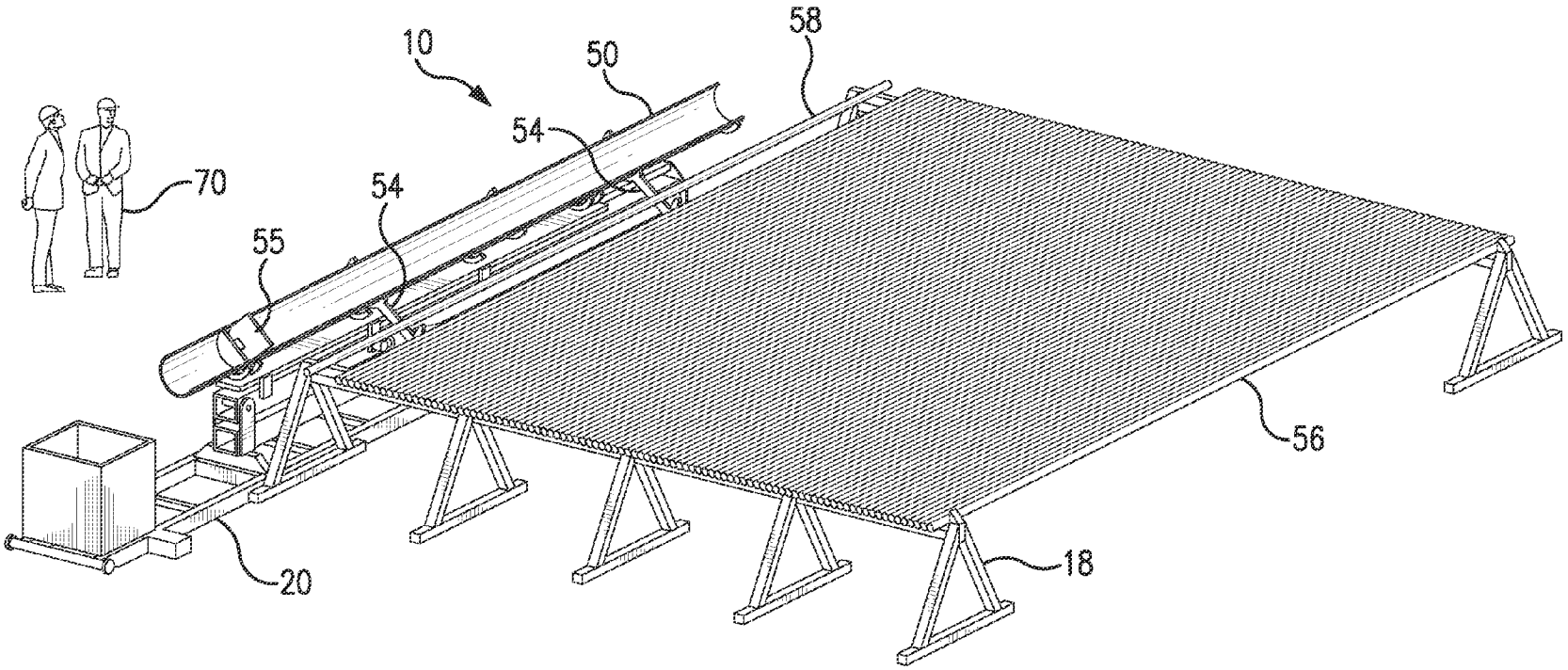
FIG. 6 illustrates the trough being rotated while picking up the tubular member.

The operator 70 then causes the trough 50 to pivot as shown in solid lines in FIGS. 3, 4 and 6 from a stationary position shown in phantom lies in FIGS. 3 and 4. The loading arms 54 move below the surface 19 of the storage rack 18, on which the tubular 56 are positioned. First, the trough 50 is tilted at 45 degrees, as shown in FIGS. 3 and 6 and the loading arms pick up the forwardmost tubular segment 58. The trough 50 is then rotated back to the starting position, as shown in an intermediate step in FIG. 4, allowing the tubular segment 58 to roll into the trough 50.

Figure 7:
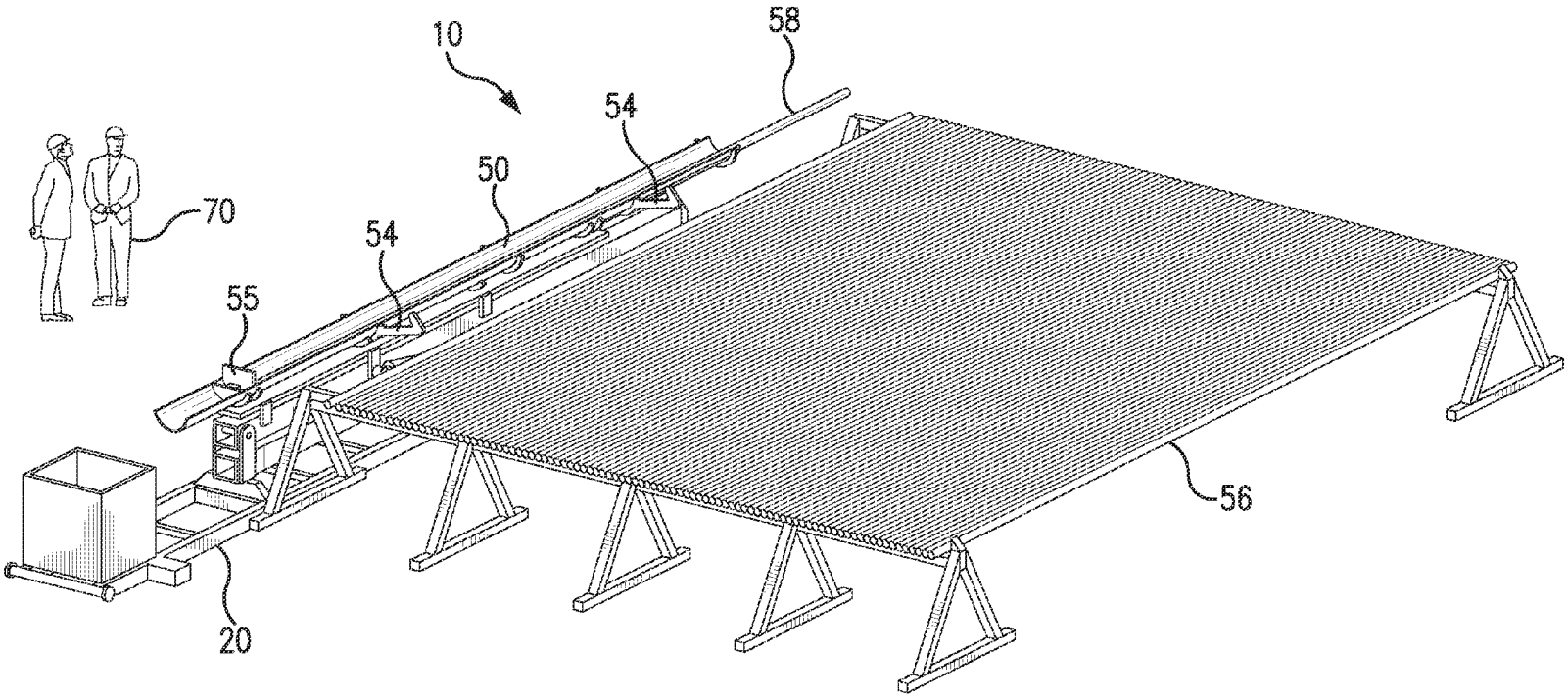
FIG. 7 illustrates the pipe handling apparatus with the pipe trough in a position ready to be elevated.
Figure 8:
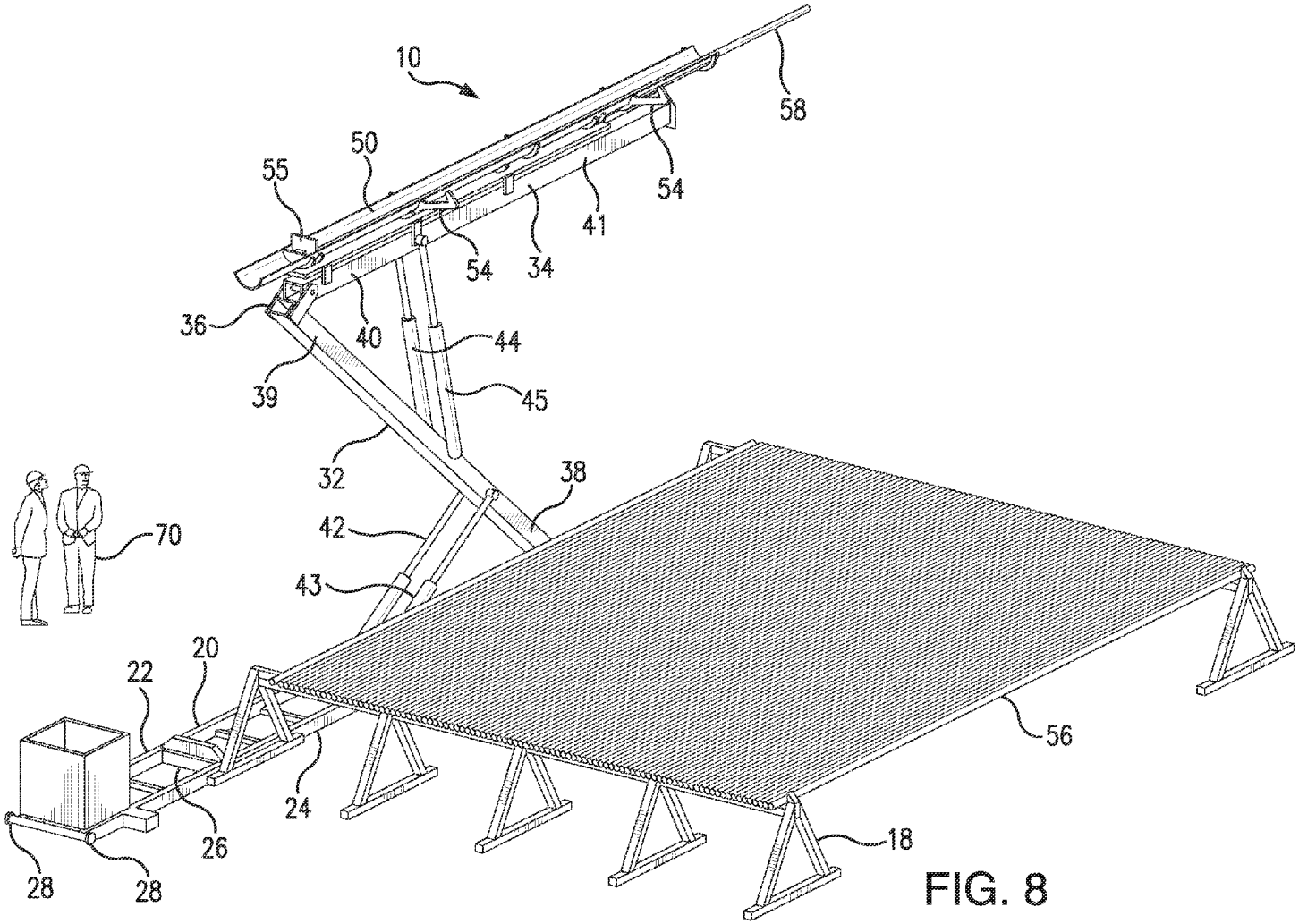
FIG. 8 illustrates the pipe handling apparatus with an elevated trough.

Since the second part 57 of the loading arm 54 is oriented at an obtuse angle in relation to the edge 52 and extends somewhat upwardly from the edge 52, the tubular 58 rolls along the second part 57 of the loading arm 54 into the trough 50. If desired, the contact surfaces of the loading arms 54 can be coated with non-abrasive coating so as not to damage exterior of the tubular 56. As the trough 50 returns to the starting position illustrated in FIGS. 5 and 7, the tubular member 58 remains in the trough Referring now to FIGS. 8-10, the process of delivering the tubular strand 58 to the rig floor will be explained. Starting from the stationary position shown in FIG. 7, the operator activates the struts 42, 43 and 44, 45 causing the first arm 32 and the second arm 34 to be gradually elevated. FIG. 8 shows the first arm 32 raised to extend at about 45 degrees in relation to the base 20 and the second arm 34 being raised at about 45 degrees in relation to a longitudinal axis of the first arm 32. The trough 50 carrying a tubular strand 58 is shown oriented horizontally, generally parallel to the ground and the base 20.

Figure 9:
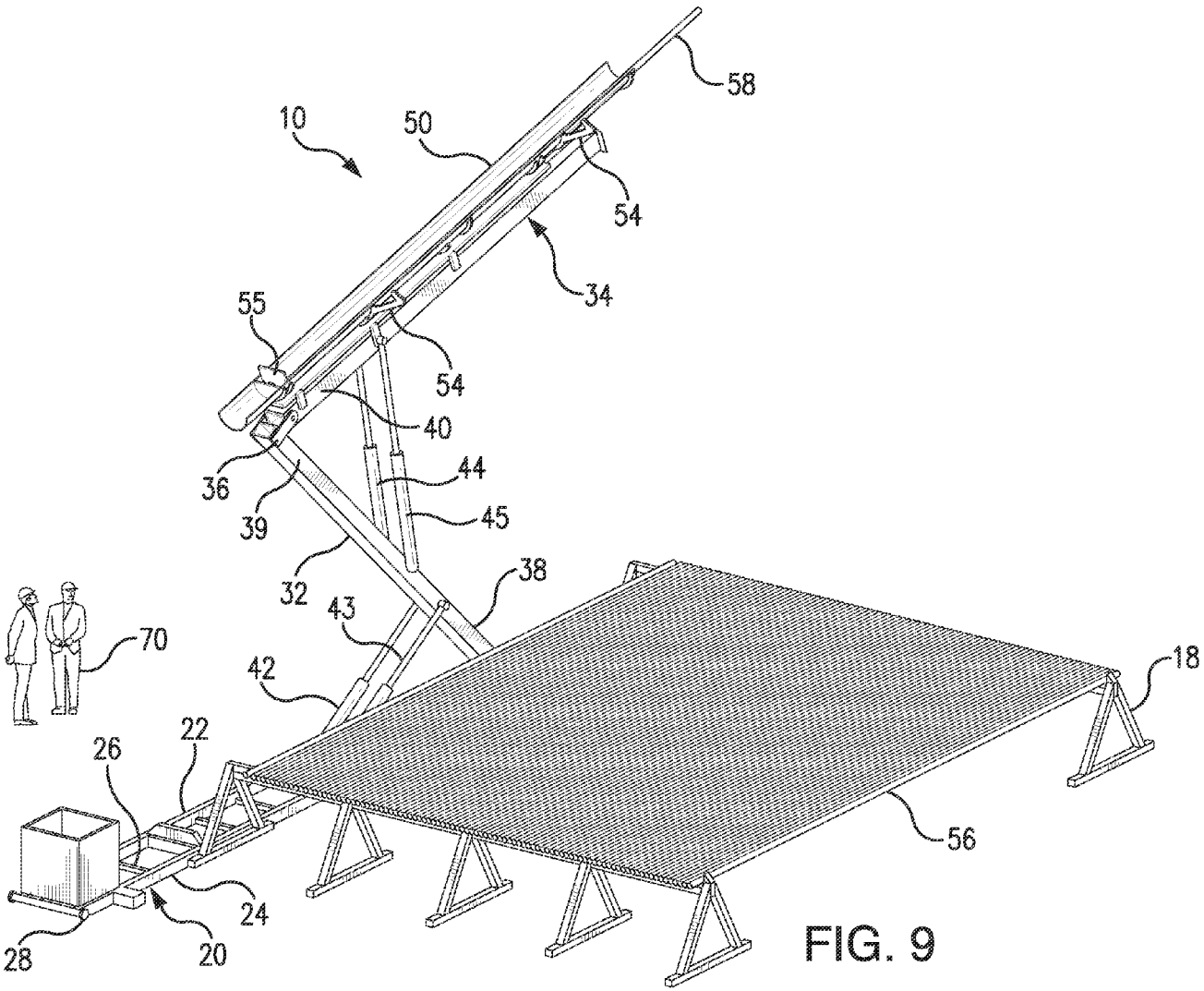
FIG. 9 illustrates the pipe handling apparatus with the elevated pipe trough in an inclined position.

FIG. 9 illustrates the struts 44, 45 further extended and lifting the trough 50 toward the floor 17 of the drilling rig 16. The trough 50 is gradually inclined, with the distant end 41 of the second arm 34 oriented upwardly at about 15 degrees in relation to a horizontal surface and the base 20. As shown in FIG. 10, the trough 50 is then caused to slide along the second arm 34 to extend closer to the drilling floor 17. The platform workers can now use gripping tools to remove the tubular 58 from the trough 50 by sliding it away from the trough 50.

Once the tubular strand 58 is unloaded to the platform 16, the operator 70 activates the power source again, retracting the trough onto the second arm 34, retracting the struts 42-45 and lowering the trough back to the stationary position. The process of loading the tubular into the trough and moving the tubular to the platform 16 is repeated several times until all required tubular strands have been incorporated into the job.

The apparatus of the present invention also provides a means for unloading the tubulars when they are no longer required on the rig 16 and depositing them onto the storage rack 18. To facilitate the unloading process, the apparatus 10 is provided with a plurality of unloading arms 72 secured adjacent the edge 51 of the trough 50. It will be understood that the positioning of the loading arms 54 and the unloading arms 72 relative to the edges of the trough 50 can be easily reversed since both the loading arms 54 and the unloading arms 72 are detachably engaged with the trough 50.

As illustrated in FIGS. 11-16, the articulate pivot assemblies 60 are now located on the "right" side of the trough 50. This arrangement is easily achieved by orienting the base 20 of the apparatus 10 such that the unloading arms 72 face the storage rack 18. In the illustration of FIGS. 11-16, the unloading arms extend from the "left" side of the trough 50.

Each of the unloading arms 72 comprises a generally planar upper surface 73 which can be covered with a protective coating so as to avoid damage to the tubular exterior. Each of the unloading arms 72 is oriented to extend at a tangent to a side of the arcuate trough 50 adjacent either edge 51 or 52. In this exemplary illustration, the unloading arms 72 are detachably secured to the underside of the trough 50 and extend upwardly in relation to the edge 51.

Figure 11:
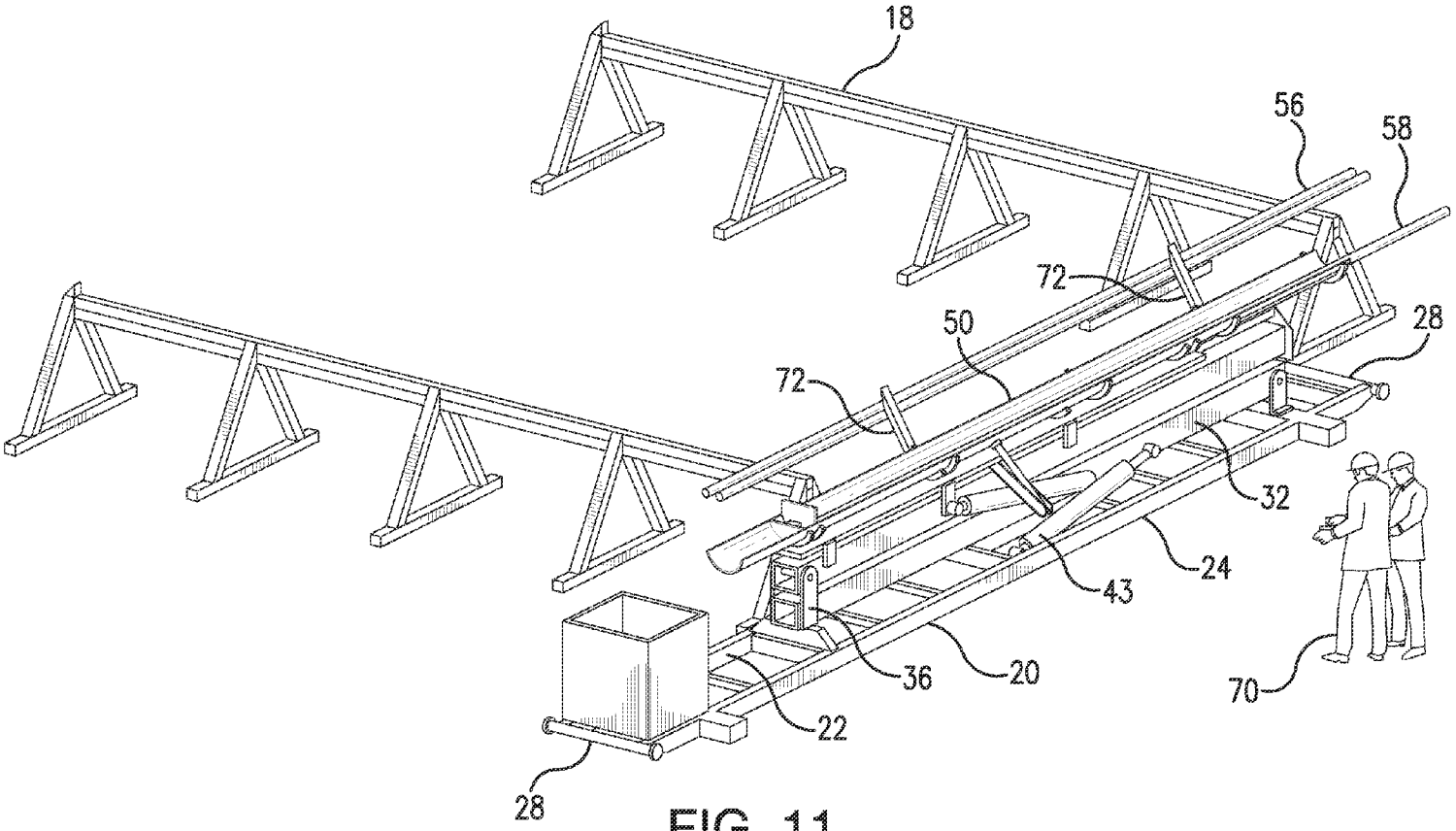
FIG. 11 illustrates the pipe handling apparatus returned to a starting position with a tubular member ready to be unloaded to the pipe rack.
Figure 13:
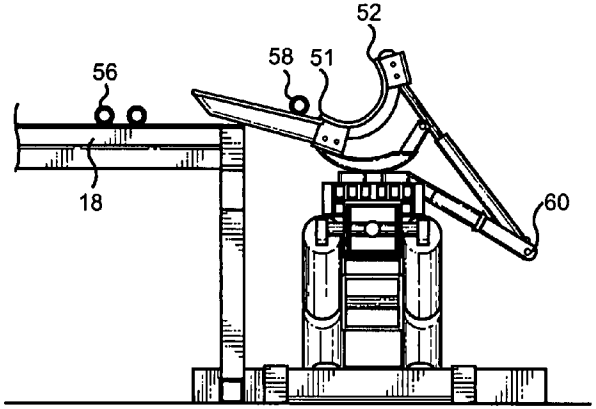
FIG. 13 is a detail side view illustrating the tilted trough with a pipe moving along the unloading arm.
Figure 12:
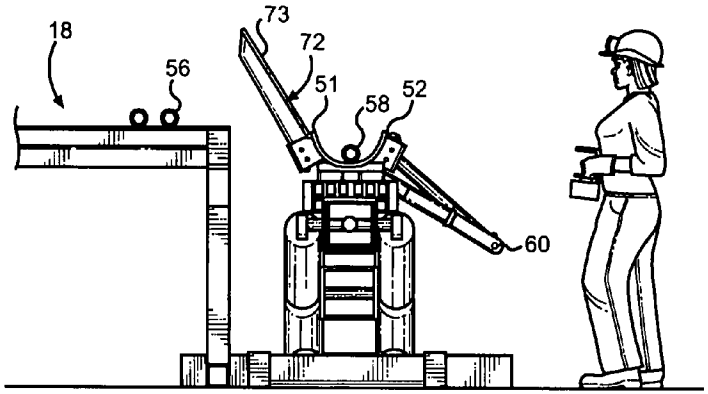
FIG. 12 is a detail side view illustrating the trough with a pipe segment ready to be unloaded.

When the drill string (or other lengths of tubular) is removed from a wellbore and is broken, it presents itself as a plurality of tubular strands that are usually stacked on the rack 18. As shown in FIG. 11, the rack 18 is ready to receive the tubular strands 56. The apparatus 10 is again positioned adjacent the rack 18 which is maneuvered to be close enough to the rig 16 and capable of moving between a fully extended position shown in FIG. 10 to a retracted position shown in FIG. 11.

Figure 14:
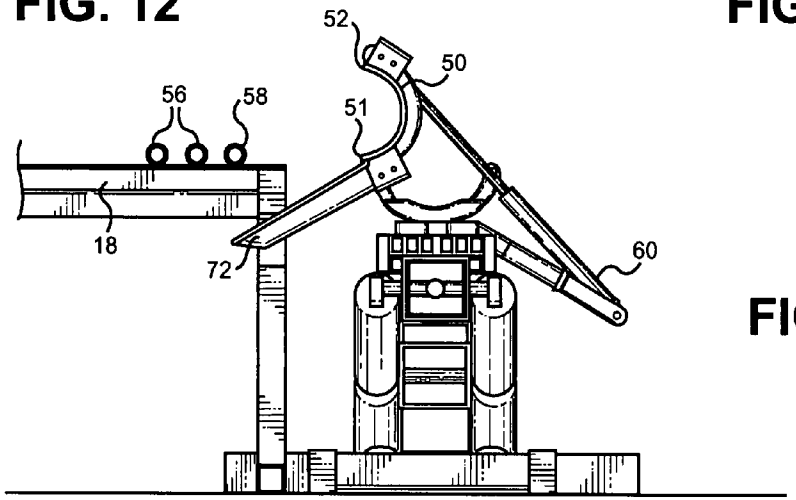
FIG. 14 is a detail side view illustrating the tilted trough with the unloaded pipe segment.
Figure 15:
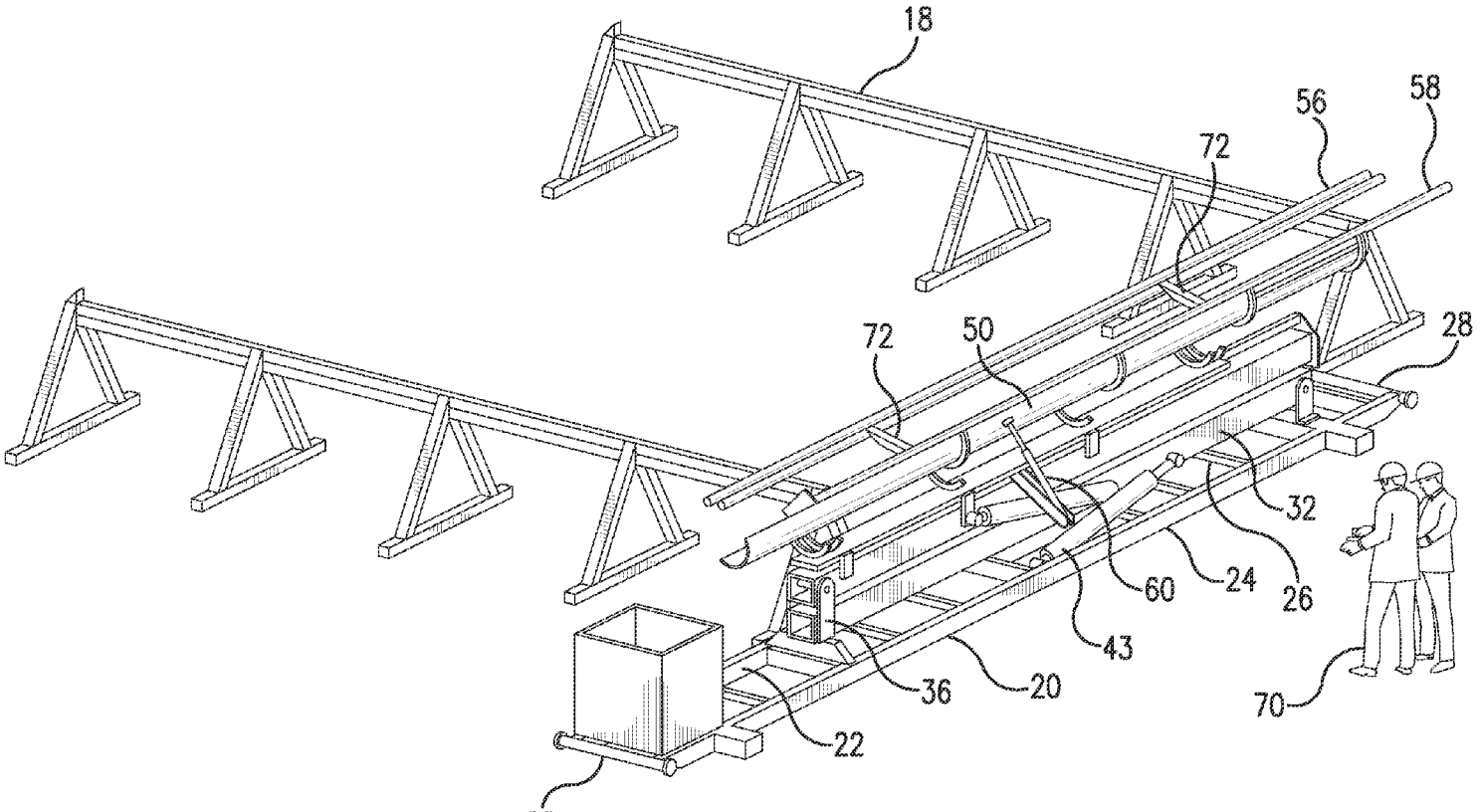
FIG. 15 illustrates the pipe handling apparatus, with the trough being tilted in a position ready to unload the tubular member.
Figure 16:
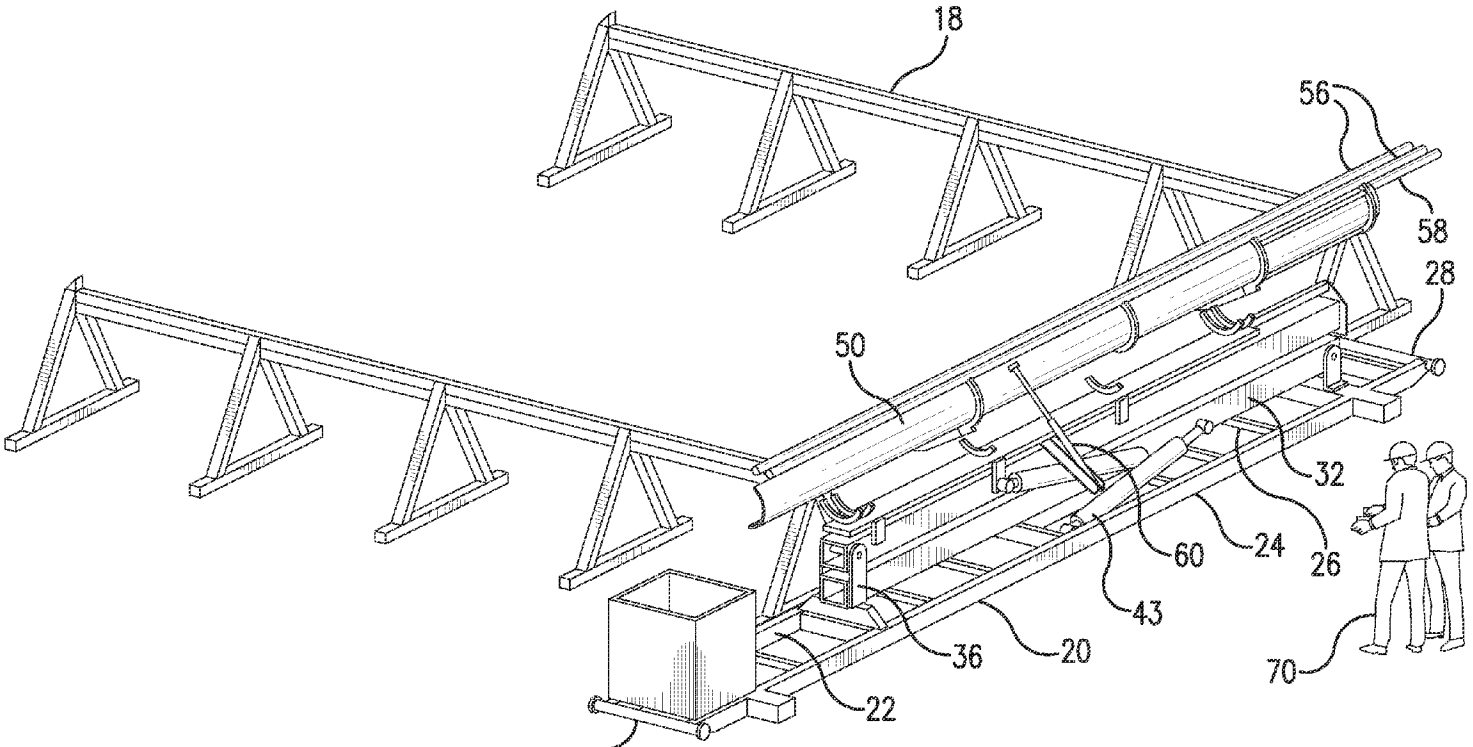
FIG. 16 illustrates the pipe handling apparatus, with the trough being fully tilted in a position of unloading the tubular member.

The tubular strand 58 deposited into the trough 50 at the platform floor is lowered to the rack 18, as shown in FIG. 11. The operator 70 activates the pivot assemblies 60 to tilt the trough first to a position shown in FIGS. 12 and 15, at 45 degrees in relation to the base 20 in order to begin unloading of the tubular 58. Since the upper surface 73 of the unloading arm 72 forms an extension of the edge 51, the tubular strand 58 is allowed to roll along the upper surface 73. Further tilting of the trough 51 by the pivot assemblies 60 causes the unloading arm 72 to a position shown in FIGS. 13 and 16, and then to 90 degrees in relation to the base 20. The tubular strand 58 thus rolls under gravity onto the rack 18 as shown in FIG. 14. The process of bringing the tubular strands from the rig 16 continues until all tubular are properly stored.

It is envisioned that the power source for operating the apparatus of the present invention can be pneumatics or geared electric motor. The use of loading and unloading arms allows to reduce the number of workers operating the pipe handling apparatus, thus substantially reducing the cost of the operation.

Many changes and modifications can be made in the apparatus and method of the present invention. I, therefore, pray that my rights to the present invention be limited only by the scope of the appended claims.

I claim:

1. An apparatus for moving a tubular member, comprising:

a base configured to be positioned adjacent a storage rack containing a plurality of tubular members;

an articulated support structure mounted on the base and movable between a folded stationary position and an extended position, said support structure comprising a first support arm, a second support arm and a connector member coupled between the second support arm and the first support arm;

a means for moving the first support arm from a first position substantially parallel to the base and a second position oriented at an acute angle in relation to the base;

a means for moving the second support atm from a first position substantially parallel to the base and a second position oriented at an obtuse angle in relation to the base;

an arcuate elongated trough extending longitudinally along the support structure, said trough having opposite parallel side edges and configured to receive the tubular member;

a plurality of spaced-apart loading arms detachably securable to the trough and extending at an obtuse angle in relation to a side edge of the trough, said loading arms moving the tubular member between the storage rack and the trough; and a plurality of spaced-apart unloading arms detachably securable to the trough and extending at a tangent to a side of the trough, said unloading arms moving the tubular member between the trough and the storage rack.

2. The apparatus of claim 1, said first support arm is pivotally movable in relation to the base, said second support arm is pivotally movable in relation to the first support arm, and said connector member is pivotally coupled between the second support arm and the first support arm.

3. The apparatus of claim 2, said trough being pivotally secured to the second support arm.

4. The apparatus of claim 1, said means for moving the first support arm comprising hydraulically movable struts coupled between the base and an underside of the first support arm.

5. The apparatus of claim 1, said means for moving the second support arm comprising hydraulically movable struts coupled between the first support arm and an underside of the second support arm.

6. The apparatus of claim 3, comprising pivot assemblies mounted between the second support arm and the trough and imparting pivotal movement on the trough during loading and unloading of the tubular member to and from the trough.

7. The apparatus of claim 1, wherein each of the loading arms comprises a substantially L-shaped body.

8. The apparatus of claim 7, wherein contact surfaces of the loading arms have a protective coating.

9. The apparatus of claim 1, wherein each of the unloading arms comprises a substantially planar upper surface.

10. The apparatus of claim 9, said upper surface of each of the unloading having a protective coating.

11. The apparatus of claim 1, said trough having a semicylindrical configuration.

12. An apparatus for moving a tubular member, comprising:

a base configured to be positioned adjacent a storage rack containing a plurality of tubular member;

an articulated support structure mounted on the base and movable between a folded stationary position and an extended position, said support structure comprising a first support arm pivotally movable in relation to the base, a second support arm pivotally movable in relation to the first support arm, and a connector member pivotally coupled between the second support arm and tile first support arm;

a means for moving the first support arm from a first position substantially parallel to the base and a second position oriented at an acute angle in relation to the base;

a means for moving the second support arm from a first position substantially parallel to the base and a second position oriented at an obtuse angle in relation to the base;

an arcuate elongated trough extending longitudinally along the support structure and mounted for pivotal movement on the second support arm of tire support structure, said trough having opposite parallel side edges and configured to receive the tubular member;

a plurality of spaced-apart loading arms detachably securable to the trough and extending at an obtuse angle in relation to a side edge of the trough, said loading arms moving the tubular member between the storage rack and the trough; and a plurality of spaced-apart unloading arms detachably securable to the trough and extending at a tangent to a side of the trough, said unloading arms moving the tubular member between tile trough and tile storage rack.

13. The apparatus of claim 12, comprising means for moving the first support arm comprising hydraulically movable struts coupled between the base and an underside of the first support arm.

14. The apparatus of claim 12, comprising said means for moving the second support arm comprising hydraulically movable struts coupled between the first support arm and an underside of the second support arm.

15. The apparatus of claim 12, comprising pivot assemblies mounted between the second support arm and the trough and imparting pivotal movement on the trough during loading and unloading of the tubular member to and from the trough.

16. The apparatus of claim 12, wherein each of the loading arms comprises a substantially L-shaped body and having contact surfaces carrying a protective coating.

17. The apparatus of claim 12, wherein each of the unloading arms comprises a substantially planar upper surface having a protective coating.

18. The apparatus of claim 12, said trough having a semicylindrical configuration.

19. A method of moving a tubular member between a horizontal storage rack and an elevated floor of a platform, the method comprising the steps of:

providing a pipe handling apparatus comprising a base configured to be positioned adjacent a storage rack containing a plurality of tubular members, an articulated support structure mounted on the base and movable between a folded stationary position and an extended position reaching to the elevated floor, an arcuate elongated trough extending longitudinally along the support structure, a plurality of spaced-apart loading arms detachably securable to the trough and extending at an obtuse angle in relation to a side edge of the trough, a plurality of spaced-apart unloading arms detachably securable to the trough and extending at a tangent to a side of the trough, wherein the support structure comprising a first support arm pivotally movable in relation to the base, a second support arm pivotally movable in relation to the first support arm, and a connector member pivotally coupled between the second support arm and the first support arm;

actuating said loading arms and moving the tubular strand from the storage rack into the trough;

actuating the support structure and elevating the trough with the tubular member to the floor of the platform.

20. The method of claim 19, comprising a step of moving the tubular member from the platform floor to the storage rack.

21. The method of claim 20, wherein the step of moving the tubular member from the platform floor to the storage rack comprises actuating the support structure and elevating the trough to the platform floor, depositing the tubular member into the trough, lowering the support structure, actuating the unloading arms and moving the tubular member from the trough onto the storage rack along the unloading arms.

22. The method of claim 19, wherein said trough is pivotally mounted on the second support arm.

23. The method of claim 19, comprising a step of providing a means for moving the first support arm from a first position substantially parallel to the base and a second position oriented at an acute angle in relation to the base.

24. The method of claim 23, said means for moving the first support arm comprising hydraulically movable struts coupled between the base and an underside of the first support arm.

25. The method of claim 19, comprising a step of providing a means for moving the second support arm from a first position substantially parallel to the base and a second position oriented at an obtuse angle in relation to the base.

26. The method of claim 25, said means for moving the second support arm comprising hydraulically movable struts coupled between the first support arm and an underside of the second support arm.

27. The method of claim 19, comprising pivot assemblies mounted between the second support arm and the trough and imparting pivotal movement on the trough during loading and unloading of the tubular member to and from the trough.

28. The method of claim 19, wherein each of the loading arms comprises a substantially L-shaped body.

29. The method of claim 28, wherein contact surfaces of the loading arms have a protective coating.

30. The method of claim 19, wherein each of the unloading arms comprises a substantially planar upper surface.

31. The method of claim 30, said upper surface of each of the unloading having a protective coating.

32. The method of claim 19, said trough having a semicylindrical configuration.

* * * * *